US007133625B2

(12) United States Patent
Yokobori et al.

(10) Patent No.: US 7,133,625 B2
(45) Date of Patent: Nov. 7, 2006

(54) IMAGE FORMING APPARATUS

(75) Inventors: Jun Yokobori, Sagamihara (JP); Masahiro Osawa, Hamura (JP); Shoichi Nakamura, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 74 days.

(21) Appl. No.: 10/923,995

(22) Filed: Aug. 23, 2004

(65) Prior Publication Data

US 2005/0152711 A1 Jul. 14, 2005

(30) Foreign Application Priority Data

Jan. 13, 2004 (JP) ..... 2004-004942

(51) Int. Cl.
*G03G 15/00* (2006.01)

(52) U.S. Cl. ..... 399/82

(58) Field of Classification Search ..... None
See application file for complete search history.

(56) References Cited

U.S. PATENT DOCUMENTS

2004/0101345 A1* 5/2004 Hirota et al. ..... 400/625

FOREIGN PATENT DOCUMENTS

JP 06321402 A * 11/1994

* cited by examiner

*Primary Examiner*—Quana Grainger
(74) *Attorney, Agent, or Firm*—Cohen, Pontani, Lieberman & Pavane

(57) ABSTRACT

An image forming apparatus is provided with an image forming section to form an image on a sheet and to discharge the sheet on which the image is formed; a stacking section to stack the sheet discharged from the image forming section; a setting section to set a condition whether or not to allow a mixed stack mode on which plural sheets related to at least two different jobs are mixed and stacked in the stacking section; and a discharge control section to control the image forming section to discharge the sheet to the stacking section in accordance with the setting condition whether or not to allow the mixed stack mode.

32 Claims, 7 Drawing Sheets

| | PRECEDING JOB | EXECUTION JOB | EVALUATION |
|---|---|---|---|
| MIXED STACKING ENABLED | ○ | ○ | START OF PAPER EJECTION |
| | ○ | × | EJECTION DISABLED |
| | × | ○ | EJECTION DISABLED |
| | × | × | EJECTION DISABLED |

IMAGE FORMING APPARATUS

BACKGROUND OF THE INVENTION

The present invention relates to an image forming apparatus for forming an image on paper and outputting the same, particularly to a paper ejection control for ejection to a stacking section.

Some of the image forming apparatuses for forming an image on paper in a printer, copying machine and printer, and for outputting it are provided with a stacker for loading a large amount of output paper with an image formed thereon. The stacker proper incorporates a stacking section equipped with an elevation function for elevating the stacked surface in response to the amount of loading. It has a capacity of loading, for example, 5,000 sheets of the paper with an image formed thereon.

Incidentally, in shortrun printing industry, post-processing of binding by drilling and stitching is performed by an offline post-processor 504, as shown in FIG. 8, in order to increase the operation efficiency. For example, when the image forming apparatus 501 is requested to execute a job of creating 100 copies of printed matter, each copy made up of 30 sheets, 3,000 sheets are loaded on the stacker 502 as a result. The loaded paper is taken out from the stacker 502 for each stacking section 503 and is carried to the offline post-processor 504, where a booklet is produced.

[Patent Document 1]

Official Gazette of Japanese Patent Tokkaihei 9-278271

Two jobs can be together subjected to post-processing; however, no mention is made of the problem that may be caused when various sheets of recording paper having been recorded in a plurality of jobs are present on the stacking section.

As shown in FIG. 8, when paper loaded on the stacker is bound in a book form by an online processor, only the paper related to one job for book binding has to be loaded on the stacking section. In an image forming apparatus wherein the next job can be registered by reservation during the output of the previous job, however, there is already no operation in many cases where the output of the reserved job has started upon termination of the previous job, with the result that the paper of the reserved job is often loaded on the paper of the previous job, according to the prior art. If paper has been loaded in this manner, the operator is required to sort out the paper related to a different job, before paper is fed to the offline post-processor. This has required much trouble and time.

In the meantime, a large number of small jobs where each job consists of 1 page or a few pages are executed continuously, and the outputs of these jobs are loaded collectively. Such a configuration of data-center form is also practiced. For example, as shown in FIG. 9, when a great number of direct mail documents having the same text and different addresses are to be printed, one job corresponds to one address. After image formation, the printed matter is put into envelopes by the offline post-processor or manually. Thus, the capability of ejecting the outputs of many jobs, one on top of another, into one and the same stacking section is essential to ensure a high level of work efficiency.

SUMMARY OF THE INVENTION

In view of the prior art problems and requirements described above, it is an object of the present invention is to provide an image forming apparatus capable of loading a large volume of paper in the form conforming to the subsequent processing requirements.

The above object can be attained by the following structure.

An image forming apparatus, comprises:

an image forming section to form an image on a sheet and to discharge the sheet on which the image is formed;

a stacking section to stack the sheet discharged from the image forming section;

a setting section to set a condition whether or not to allow a mixed stack mode on which plural sheets related to at least two different jobs are mixed and stacked in the stacking section; and a discharge control section to control the image forming section to discharge the sheet to the stacking section in accordance with the setting condition whether or not to allow the mixed stack mode.

Further, the above object may be attained by the following preferable structure.

The structure of item 1 is an image forming apparatus for forming an image on paper and outputting it, comprising:

a stacking section 80 for stacking the sheets of paper having been ejected;

a residual paper detecting section 241 for detecting whether or not the sheets of paper are loaded on the stacking section 80;

setting acceptance sections 220, 110, 120 and 3 for accepting the setting of whether or not the mixed stacking should be enabled, wherein the sheets of paper of two or more jobs are loaded on the stacking section 80 in a mixed form;

a paper ejection control section 111 for disabling the paper of the next job to be ejected to the stacking section 80, in response to the state of detection by the residual paper detecting section 241, and the state of the setting of whether the mixed stacking should be enabled or disabled.

According to the aforementioned structure, the setting of whether or not the mixed stacking should be enabled is accepted from a user, wherein the sheets of paper of two or more jobs are loaded on the stacking section 80 in a mixed form; then, control is provided to determine whether or not ejection of paper of the next job to the stacking section 80 is disabled or not, in response to the state of detection on whether or not paper remains in the stacking section 80, and the state of the setting of whether or not the mixed stacking should be enabled.

For example, when starting the image formation of the next job, evaluation is made to determine whether or not the paper of the preceding job remains in the stacking section 80. If paper still remains in the stacking section 80 and the setting has been made not to enable the mixed stacking, execution of the image formation processing of the next job is postponed, or the destination of paper ejection is switched over to another stacking section or paper ejection tray, thereby disabling the paper to be ejected to the stacking section 80 with paper remaining therein. When execution of the image formation processing of the next job is postponed, image formation processing of the next job should be started upon removal of the paper from the stacking section 80.

When the output paper of the preceding job is not remaining in the stacking section 80 or a setting has been made to enable mixed stacking, the ejection of paper of the next job into the stacking section 80 with paper remaining therein is not disabled; ejection of paper to the stacking section 80 is enabled.

It is possible to arrange such a configuration that, when there are a plurality of stacking sections 80, setting of whether the mixed stacking is enabled or disabled is provided for each stacking section 80. In this case, arrangements should be made in such a way as to determine if the ejection of paper to the stacking section 80 is disabled or not, based on the setting of the mixed stacking for the stacking section 80 specified as the destination of output in the next job and the stacking of sheets in the stacking section 80. It should be noted that the job means a set of work serving as a unit when a user requests the image forming apparatus to perform processing.

The structure of item 2 is an image forming apparatus for forming an image on paper and outputting it, comprising:

a stacking section 80 for stacking the sheets of paper having been ejected;

a residual paper detecting section 241 for detecting whether or not the sheets of paper are loaded on the stacking section 80;

setting acceptance sections 220, 110, 120 and 3 for accepting, for each job, the setting of whether or not the mixed stacking should be enabled, wherein the sheets of paper of the current job and those of other jobs are loaded on the stacking section 80 in a mixed form;

a paper ejection control section 111 for disabling ejection of paper of the next job to the stacking section 80, in response to the state of setting of whether the mixed stacking in the preceding job is enabled or disabled, and the state of the setting of whether the mixed stacking in the next job is enabled or disabled, when paper of the preceding job is loaded in the stacking section 80.

According to the aforementioned structure, the setting of whether the mixed stacking is enabled or disabled can be provided for each job. When the paper of the preceding job is stacked on the stacking section 8, control is provided in such a way as to determine if ejection of the paper of the next job to the stacking section 80 is disabled or not, in response to the setting of the mixed stacking in the preceding job and the setting of the mixed stacking in the next job.

The setting for each job should be provided, for example, when registering or reserving the job. When there are a plurality of stacking section, evaluation is made to determine if ejection of paper to the stacking section is disabled or not, based on the setting of the mixed stacking in the next job; the stacking of paper in the stacking section specified as the output destination by this job; and the setting of mixed stacking in the destination job where paper is loaded in the stacking section.

The structure of item 3 is an image forming apparatus described in item 2, wherein, when the aforementioned mixed stacking is enabled by both the preceding job and next job, the paper ejection control section 111 enables paper of the next job to be ejected to the stacking section 80.

According to the aforementioned structure, even if the paper of the preceding job remains in the stacking section 80, the paper of the next job can be ejected to the same stacking section 80 as that of the preceding job, if mixed stacking is enabled by both the preceding job and the next job. Since the paper can be ejected if mixed stacking is enabled by both the preceding job and the next job, the current setting of the mixed stacking in any of the jobs is observed.

The structure of item 4 is an image forming apparatus described in item 2, wherein, when the mixed stacking is not enabled by the preceding job, the control section disables the ejection of the paper of the next job to the stacking section 80, at least while the paper of the preceding job is loaded in the stacking section 80.

According to the aforementioned structure, when the preceding job with paper remaining in the stacking section 80 does not enable mixed stacking, ejection of paper of the subsequent job to the stacking section 80 is disabled. In this case, ejection is disabled, regardless of whether the subsequent job enables mixed stacking or not. It is preferred to arrange such a configuration that paper ejection is enabled upon removal of the paper of the preceding job from the stacking section 80.

The structure of item 5 is an image forming apparatus described in item 2, wherein, when the mixed stacking is not enabled by the next job, the control section disables the ejection of the paper of the next job to the stacking section 80, at least while the paper of the preceding job is loaded in the stacking section 80.

According to the aforementioned structure, when paper of the preceding job remains in the stacking section 80 and the next job does not enable mixed stacking, ejection of paper of the subsequent job to the stacking section 80 is disabled. In this case, ejection is disabled, regardless of whether the preceding job enables mixed stacking or not. It is preferred to arrange such a configuration that paper ejection is enabled upon removal of the paper of the preceding job from the stacking section 80.

The structure of item 6 is an image forming apparatus described in one of the items 1, 2, 3, 4 and 5, comprising reporting sections (220 and 110) for reporting that the aforementioned control section has disabled ejection of the paper of the next job to the stacking section 80 when the control section has done so.

According to the aforementioned structure, a report is issued to notify that the paper of the next job cannot be ejected to the stacking section 80 because the paper of the preceding job remains in the stacking section 80, when such inability of ejection has occurred. In this case, any method of reporting—display of a message, sounding of a buzzer or display of a problem solution (removal of paper from stacking section)—can be used.

The structure of item 7 is an image forming apparatus described in one of the items 1, 2, 3, 4, 5 and 6, wherein the aforementioned setting acceptance sections 220, 110 and 120 receives from the external apparatus 3 the information on the setting of whether mixed stacking is enabled or not.

According to the aforementioned structure, the information on the setting of whether mixed stacking is enabled or not can be received from the external apparatus (3). In this case, the external apparatus 3 can be of any type. The setting can be made from an external computer or the like via the network such as LAN (Local Area Network), communications line and communications cable. For example, when the print job is received from an external computer, information denoting the enable/disable status of mixed stacking together with the print data is received from the printer driver of the computer apparatus, whereby the setting of mixed stacking is accepted.

The structure of item 8 is an image forming apparatus described in one of the items 1, 2, 3, 4, 5, 6 and 7, wherein the image forming operation of the next job is disabled, thereby disabling the ejection of paper to the stacking section 80.

According to the aforementioned structure, even when there is only one stacking section 80 or change of the stacking section 80 at the destination of ejection is disabled, ejection of paper to the relevant stacking section is disabled by disabling the image forming operation.

According to the image forming apparatus of the present invention, a user is allowed to select between enabling and disabling of the mixed stacking wherein the paper of the next job is ejected to the same stacking section when the paper of the preceding job remains in that stacking section. Thus, mixed stacking is disabled when the stacked sheets of paper is used for bookbinding by an offline post-processor. The mixed stacking is enabled, when continuous execution of many small jobs, each of which consists of one or a few pages, for example, in the case of creating a direct mail, and the outputs of these many jobs are collectively stacked. This arrangement provides suitable stacking of paper conforming to each of different forms of usage, and ensures compatibility with different stacking requirements.

When the enable/disable status of mixed stacking can be set for each job, minute setting of the enable/disable status of mixed stacking is possible. Especially when the job is reserved, it is possible to set the enable/disable status of the mixed stacking in the reserved job, independently of the setting of the mixed stacking in other jobs during image formation at that time. The advantages of reservation can be utilized for the form of stacking.

DETAILED DESCRIPTION OF THE PREFERRED EMBODIMENT

Figure 2:
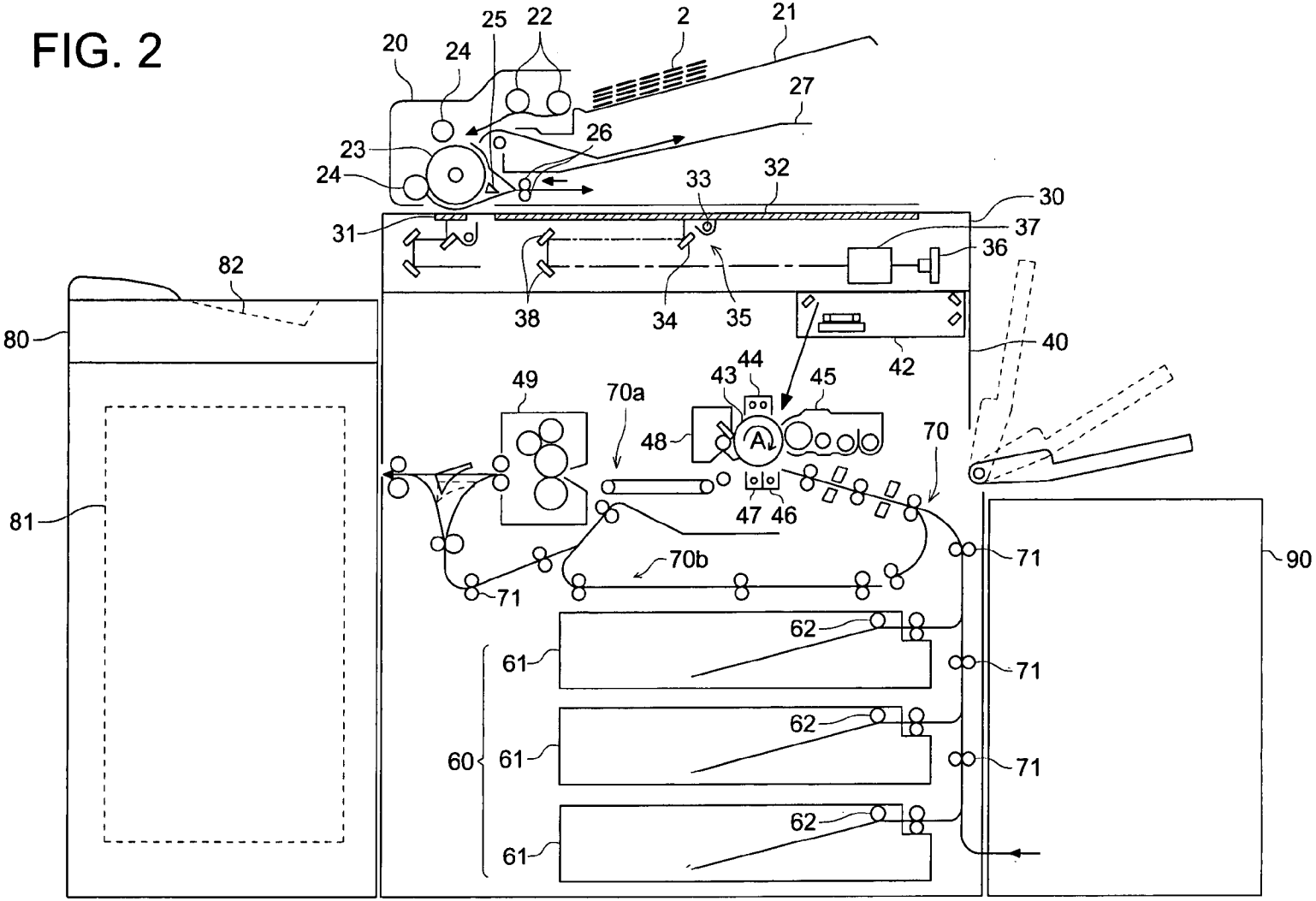
FIG. 2 is a cross sectional view representing an image forming apparatus as an embodiment of the present invention.

The following describes the embodiments of the present invention with reference to drawings:

FIG. 2 shows an example of an image forming system with a high-volume sheet feed tray 90 connected to the image forming apparatus 10 of the present invention. The image forming apparatus 10 is a so-called digital multifunction device having a copying function of reading the document and forming its copied image on paper, and a printing function of receiving print data from such an external apparatus as a computer and forming the corresponding image on paper and outputting it.

The image forming apparatus 10 comprises an automatic document conveyance apparatus 20, a reading section 30, a printing section 40 and a stacker apparatus 80 capable of accommodating a large volume of paper with an image formed thereon. The automatic document conveyance apparatus 20 feeds each of the documents loaded on the document accommodation tray 21 to the reading position of the reading section 30. For the double-sided document, one side is read first, and the document is then reversed and fed again into the reading section 30.

The automatic document conveyance apparatus 20 comprises a sheet feed roller 22 for feeding the documents 2 placed on the document accommodation tray 21, sequentially starting from the topmost one; a contact roller 23 for feeding the document kept in close contact with a contact glass 31; and a guide roller 24 for guiding the document fed by the sheet feed roller 22, along the contact roller 23. It further includes:

a switching claw 25 for switching the direction of the course of the document having passed through the contact glass 31;

a reversing roller 26 for reversing the double sided document; and an ejection tray 27 for ejecting the documents having been read.

The reading section 30 reads the document fed in by the automatic document conveyance apparatus 20 and outputs the corresponding image data. The reading section 30 also includes:

an exposure scanning section 35 composed of a light source 33 and a mirror 34;

a line image sensor 36 for receiving the light reflected from the document and outputting the electric signal in response to the light intensity;

a condensing lens 37 for condensing the light reflected from the document to the line image sensor 36; and various mirrors 38 forming an optical path for guiding the light reflected from the mirror 34 of the exposure scanning section 35, to the line image sensor 36.

When reading the document fed in by the automatic document conveyance apparatus 20, the exposure scanning section 35 moves to the reading position below the contact glass 31 and stops there to read the document fed by the contact roller 23 thereover. When reading the document placed on a platen glass 32, the exposure scanning section 35 travels from left to right along the bottom surface of the platen glass 32, thereby reading the document remaining at rest.

The printing section 40 forms an image conforming to the image data on paper based on electrophotographic process. The printing section 40 has a laser unit 42 for outputting a laser beam that turns on and off in response to the image data. The printing section 40 is also provided with a photoconductor 43 for forming an electrostatic latent image, a charging device 44 arranged around it, a developing apparatus 45, a transfer apparatus 46, a separation apparatus 47 and a cleaning apparatus 48.

The photoconductor 43 forms a cylindrical form and is rotated in a predetermined direction (marked by arrow A in the drawing) by the drive section (not illustrated). The charging device 44 uniformly charges the photoconductor 43 through corona discharging. The surface of the photoconductor 43 charged uniformly can be scanned by the laser beam that turns on and off in response to the image data, whereby an electrostatic latent image is formed on the surface of the photoconductor 43. The electrostatic latent image formed on the surface of the photoconductor 43 is made visible as a toner image by the developing apparatus 45.

The transfer apparatus 46 transfers the toner image of the surface of the photoconductor onto paper by applying an electric field. The separation apparatus 47 separates paper from the photoconductor 43 by electric charge elimination. After transfer, the cleaning apparatus 48 removes and collects the toner remaining on the photoconductor 43 by scraping with a blade or the like. The collected toner is fed back to the developing apparatus 45 through the path (not illustrated). The fixing apparatus 49 fixes the toner image onto paper by applying pressure and heat.

The toner separation section 60 has a plurality of sheet feed cassettes 61. They normally accommodate sheets of paper having different size and type. The first sheet feed roller 62 feeds the sheets of paper held in the sheet feed cassette 61, sequentially starting from the topmost one, and sends them to the sheet conveyance section 70. The sheet feed path from the high-volume sheet feed tray 90 is omitted from the drawing.

The sheet conveyance section 70 comprises:

a normal path 70*a* for ensuring that the paper fed out of the sheet feed cassettes 61 passes through the transfer position between the photoconductor 43 and transfer apparatus 46, and is ejected to the succeeding stacking apparatus 80 through the fixing apparatus 49 located downstream; and a reversing path 70*b* for reversing the paper having passed through the fixing apparatus 49 and again meeting the normal path 70*a* upstream from the transfer position thereafter. When the paper passes through the normal path 70*a*, an image is formed on the paper. When paper passes through the normal path 70*a* again after having passed through the reversing path 70*b*, an image is formed on the back of paper. Each of the paths 70*a* and 70*b* contains many conveyance rollers 71 arranged at an interval smaller than the size of the minimum-sized paper in the feed direction.

The stacking apparatus 80 incorporates a stacking section having an elevation function of elevating the stacked surface in response to the amount of stacking. For example, it has a capacity of stacking 5,000 sheets of paper with an image formed thereon. When paper is not loaded, the stacking section 81 is located at the topmost position, and is lowered as sheets of paper are loaded. When the loaded paper is removed, the stacking section 81 goes upward. The bottom of the stacking section 81 is provided with a wheel. When the door on the side of the stacking apparatus 80 is opened, the stacking section 81 can be pulled out to carry paper to the post-processor or the like.

A sub-plate 82 that allows stacking of the sheets of paper with an image formed thereon is provided on the top of the stacking apparatus 80. The stacking apparatus 80 is capable of selecting whether paper should be stacked on the stacking section 81 or sub-plate 82. A user is allowed to select the stacking section 81 or sub-plate 82 as a destination of paper ejection for each job.

Figure 3:
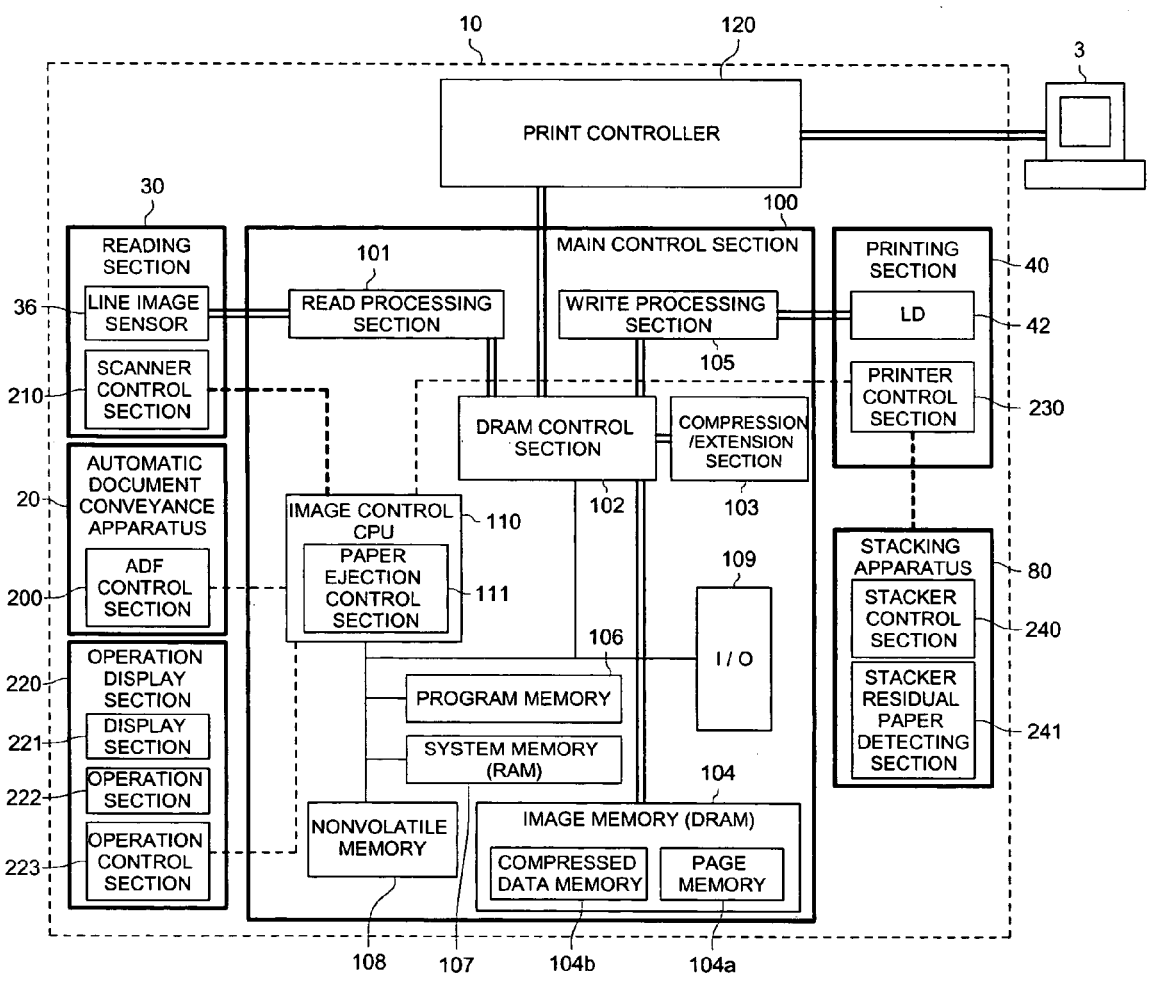
FIG. 3 is a block diagram showing the configuration of an image forming apparatus as an embodiment of the present invention.

FIG. 3 is a block diagram showing the electrical configuration of the image forming apparatus 10. The automatic document conveyance apparatus 20 has an ADF control section 200 for controlling the drive section (not illustrated). The reading section 30 has a line image sensor 36 and scanner control section 210. The scanner control section 210 controls the lighting of the light source 33 and the traveling of the exposure scanning section 35.

The potential detecting means 220 receives various operations of a user and displays various type of formation to the user. It also has a function of setting acceptance section. An operation display section 220 includes:

a display section 221 consisting of a liquid crystal display;

an operation section 220 consisting of a touch switch arranged on the screen and other switches; and an operation control section 223 for controlling the operation of the display section 221 and operation section 222.

The printing section 40 has a laser unit 42 and a printer control section 230. The printer control section 230 has a function of administrative control of the rotation of a polygon mirror; application of power to the charging device 44, transfer apparatus 46 and separation apparatus 47; rotation of the photoconductor 43; and the operations of the developing apparatus 45, cleaning apparatus 48, fixing apparatus 49, sheet feed section 60 and sheet conveyance section 70.

The stacking apparatus 80 comprises a stacker control section 240 for controlling the operation of the elevator of the stacking section 81; and a stacker residual paper detecting section 241 for detecting if paper is stacked on the stacking section 81 or not. The stacker residual paper detecting section 241 consists of, for example, a reflection type light sensor and an actuator for blocking light of this light sensor by displacement, depending on whether paper is stacked or not. The stacker residual paper detecting section 241 can adopt any detection method so long as stacking of paper can be detected.

The aforementioned ADF control section 200, scanner control section 210, operation section 220, printer control section 230 and stacker control section 240 consist of the circuits where the CPU, ROM and RAM are the major components. Various forms of control are executed according to the program stored in the ROM.

The main control section 100 provides administrative control of the operation of the image forming apparatus 10. The main control section 100 comprises a read processing section 101, DRAM control section 102, compression/extension section 103, image memory 104, write processing section 105, program memory 106, system memory 107, nonvolatile memory 108 and I/O port 109 and image control CPU 110.

The read processing section 101 applies processing of enlargement and mirror imaging, and binary processing by error diffusion to the image data outputted by the reading section 30. The compression/extension section 103 compresses the binarized image data and decompressed the once compressed data to restore the original image data. The image memory 104 performs the function as a page memory 104*a* capable of storing the non-compressed image data in units of page and the function as a compressed data memory 104*b* for storing the compressed image data.

The write processing section 105 sends the image data, read from the image memory 104 and decompressed thereafter, to the laser unit 42 at timed intervals conforming to the operation of the printer 40. The DRAM control section 102 controls the read/write and refresh timing with respect to the image memory 104 consisting of a dynamic RAM. It also controls the timing of compressing the image data and storing it in the image memory 104, and reading the compressed data from the image memory 104 and decompressing it.

The image control CPU 110 is a central processor unit for controlling the entire operation of the copying apparatus 10. It controls the image data flow and performs the functions of managing the reservation, registration and execution of a job. The program memory 106 stores the program executed by the image control CPU 110. The system memory 107 is a work memory for various data items on a temporary basis during the execution of the program. The nonvolatile memory 108 stores the user data and system data that should be stored even after the power has been turned off. The I/O port 109 is connected with various sensors and LEDs.

A print controller 120 receives print data from an external apparatus 3 such as a personal computer through the LAN and network, and performs the function of expanding it into a raster image data.

The image forming apparatus 10 provides a copying function by a combination of:

the processing of compressing the image data obtained by reading through the document reading section 30; and the processing of image formation wherein the image data is read from the compressed data memory 104*b* and is decompressed, and an image is formed on paper by the printing section 40.

In the processing of scanning the document, the data is read from the line image sensor 36 of the reading section 30 and is sent to the control section 101, DRAM control section 102, compression/extension section 103 (compress), DRAM control section 102 and compressed data memory 104*b*, in that order. In the processing of image formation, the data is sent from the compressed data memory 104*b* to the DRAM control section 102, compression/extension section 103, DRAM control section 102, write processing section 105 and laser unit 42, in that order. Paper is fed under the control of the printer control section 230 and is ejected to the stacking apparatus 80 after the image has been transferred and fixed in position.

The printer function is achieved by a combination of the processing of document input wherein the print data is received and expanded into image data, and is then compressed and stored into the compressed data memory 104*b*; and the processing of image formation described above. In the processing of document input, data is sent to the application program and printer driver of the external apparatus 3, DRAM control section 102 compression/extension section 103 (compress), DRAM control section 102 and compressed data memory 104*b*, in that order.

Use of the compressed data memory 104*b* serving an intermediary allows the image forming apparatus 10 to read or input the document of the next job during execution of image formation of the current job, and to reserve and register the job. For example, when there are many copies to be taken, the document is read once for each page of the document, but processing of image formation is repeated by the number of times equivalent to the copies required. This arrangement allows the reading section 30 to be unoccupied during execution of the image formation, so that the next job can be reserved and registered.

The image forming apparatus 10 is capable of setting, for each job, the information on whether mixed stacking is enabled or not, the mixed stacking being the mode of stacking wherein sheets of paper of the current job and other jobs are loaded on the stacking apparatus 80 in a mixed form. The image forming apparatus 10 has the control function of determining if the ejection of the paper of the next job to the stacking apparatus 80 should be disabled or not, in conformity to the setting of mixed stacking in each of that job and the preceding job and the presence/absence of paper on the stacking apparatus 80, when starting the processing of image formation of the next job.

Execution of the image formation of the next job is postponed until the paper of the preceding job is removed from the stacking apparatus 80, whereby ejection of paper to the stacking apparatus 80 is disabled.

The function of a setting acceptance section for accepting the setting of whether mixed stacking is enabled or not is achieved by the operation display section 220 and image control CPU 110. When accepting the setting from the external apparatus 3, the print controller 120 also performs the function as a setting acceptance section partly.

The image control CPU 110 has a function of the paper ejection control section 111 for determining if ejection of paper of the next job to the stacking apparatus 80 is disabled or not. The image control CPU 110 of the operation display section 220 provides the function of reporting means for reporting that ejection of paper of the next job to the stacking apparatus 80 is disabled, whenever this ejection has been actually disabled.

Figure 4:
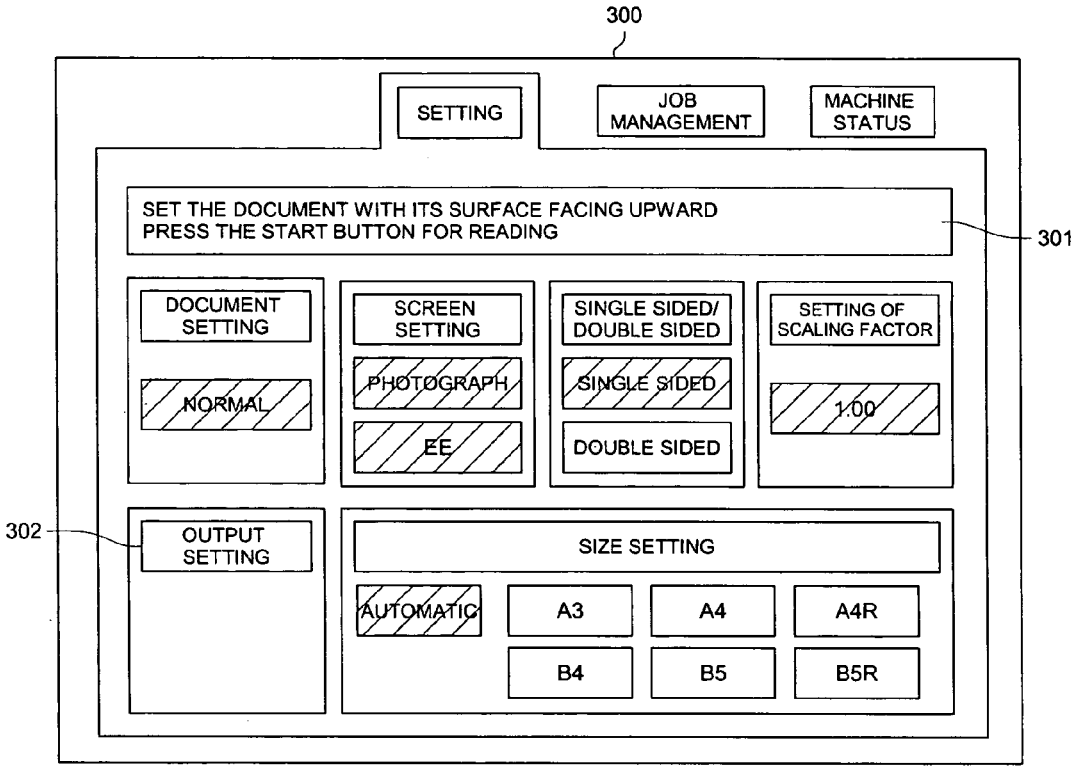
FIG. 4 is an explanatory diagram representing the operation display section of an image forming apparatus as an embodiment of the present invention.

FIG. 4 shows a basic screen 300 for receiving the request from a copy shop. The basic screen 300 contains various letters and patterns for reporting the settings to the user, and various operation keys for modifying the current settings. In the drawing, the hatched operation keys and display columns indicate the settings selected for the item. A message display column 301 indicating various information guides and warnings are displayed is arranged on the upper portion of the basic screen 300.

Figure 5:
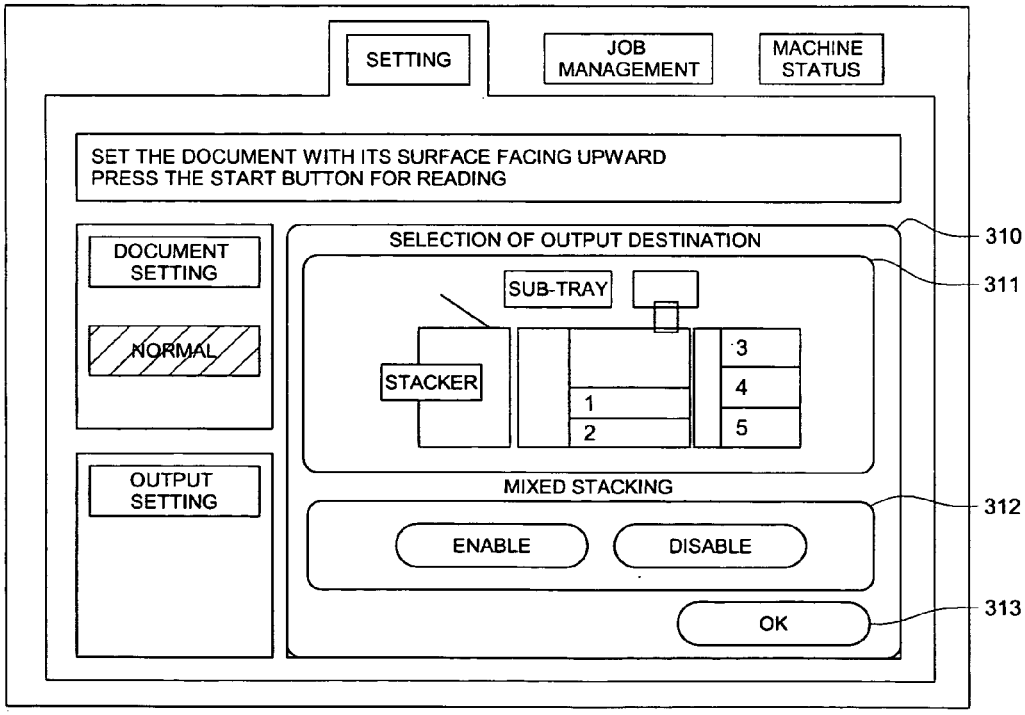
FIG. 5 is an explanatory diagram of an example showing how an output setting screen pops up on the basic screen by operating the Output Setting button of FIG. 4.

When the Output Setting button 302 on the basic screen 300 is pressed, the output setting shown in FIG. 5 is popped up for display. The output setting screen 310 has an output destination selection column 311 and a mixed stacking selection column 312. The output destination selection column 311 allows selection between the stacking section 81 and sub-plate 82 as a paper ejection destination. The mixed stacking selection column 312 makes it possible to select if the mixed stacking should be enabled or not, for the jot to be registered. Immediately when the OK button 313 is pressed, the selection is determined and the setting is established.

Figures 6, 7:
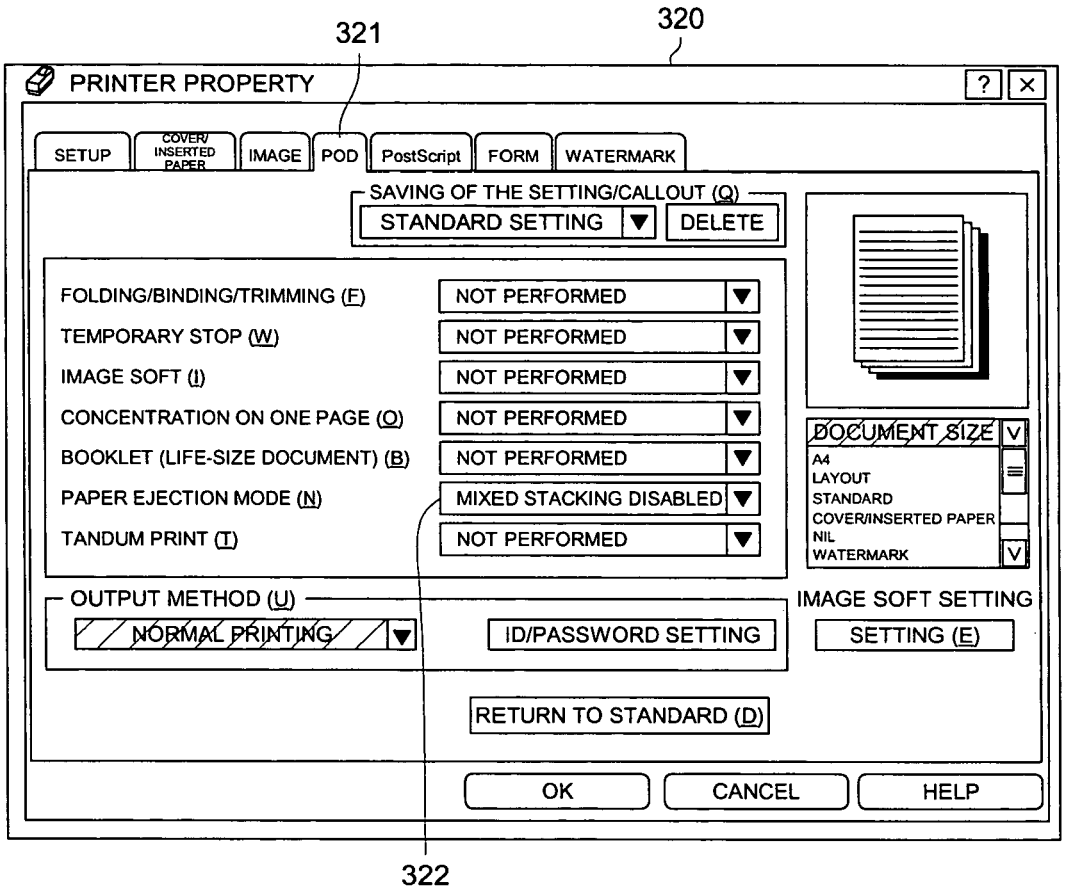
FIG. 6 is an explanatory diagram representing an example of the printer property screen displayed by the printer driver of an external apparatus for sending print data to an image forming apparatus as an embodiment of the present invention.
FIG. 7 is a list summarizing the result of evaluation when paper remains in the stacking section in paper ejection control of FIG. 6.

FIG. 6 shows an example of the printer property screen 320 indicated by the printer driver of the external apparatus 3 on the display of the apparatus thereof, when request for printing job is given from the external apparatus 3 to the image forming apparatus 10. The printer property screen 320 shown in FIG. 6 indicates the status when the POD tag 321 has been selected. When the POD tag 321 has been selected, settings for post-processing such as folding and binding can be made, and paper ejection mode, and selection of the enable/disable status of the mixed stacking can be made, using the paper ejection mode selection column 322 of pull down menu format.

The information on the setting of mixed stacking status (enable/disable status) is added to the print data sent from the printer driver to the image forming apparatus 10. The image forming apparatus 10 identifies the current setting of stacking in the current print job, based on this additional information.

It is also possible to make such arrangements that setting of mixed stacking enable/disable status is provided as a default. In this case, "Mixed stacking: Disabled" is displayed as a default setting, when the select screen given in FIG. 5 or 6 has appeared. This setting can be kept unchanged if the user is satisfied. If not, the setting can be changed. This arrangement saves the time of setting. The default setting can be changed as required, depending on the method of use or the time of use.

Figure 1:
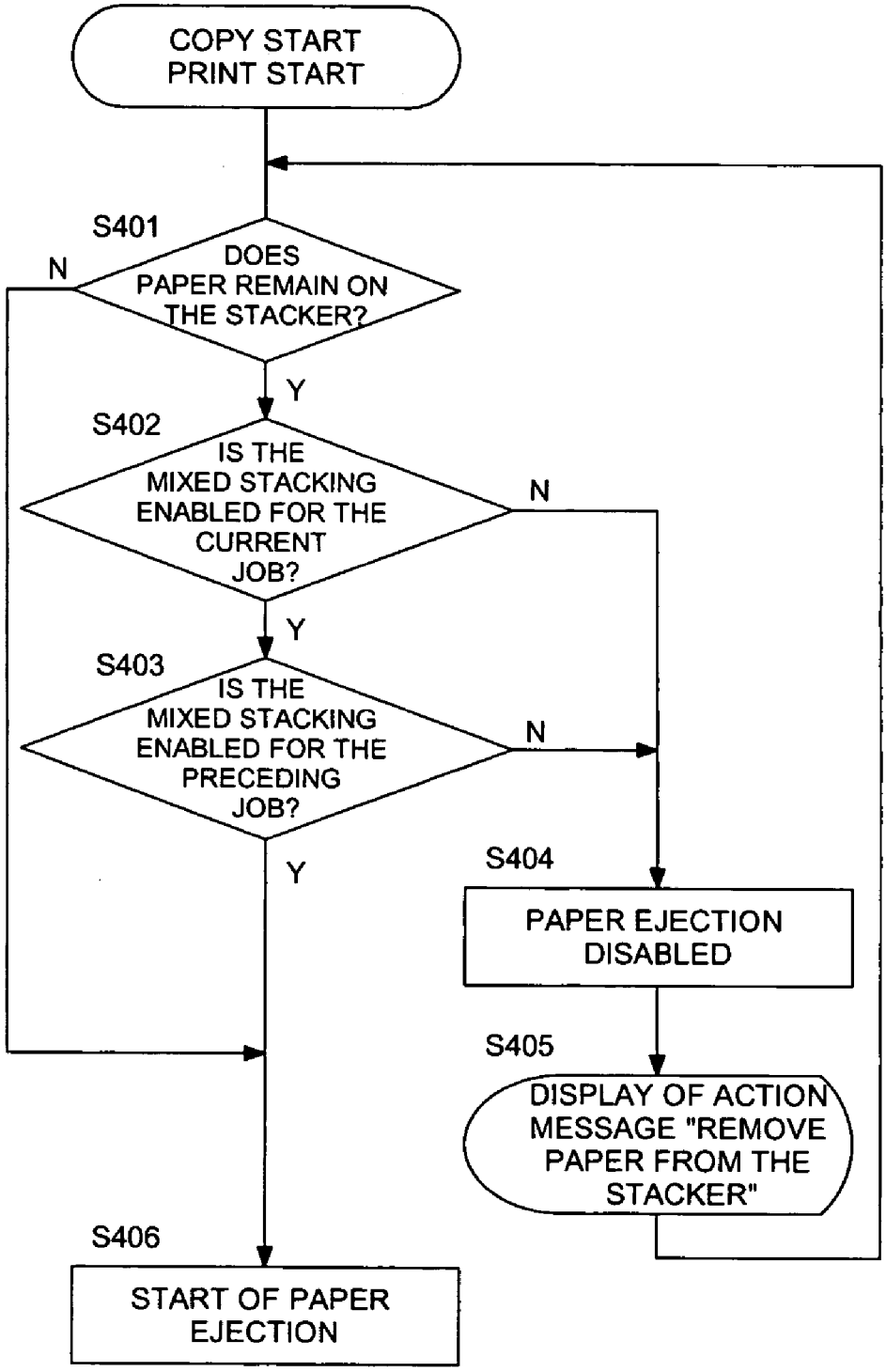
FIG. 1 is a flowchart representing paper ejection control by an image forming apparatus as an embodiment of the present invention.

FIG. 1 shows the flow of the processing of paper ejection carried out when starting the processing of image formation for the next job (prior to processing of image formation of the first page). In this case, the destination of ejection for each job is assumed to be set on the stacking section 81 of the stacking apparatus 80. In the first place, prior to processing of image formation of the current job (or the next job as viewed from the preceding job), evaluation is made to see if paper of the preceding job remains in the stacking section 81 of the stacking apparatus 80 (Step S401). If not (N in Step S401), processing of the image formation for the current job starts. The paper with an image formed thereon is ejected to the stacking section 81 (Step S406).

If paper still remains in the stacking section 81 of the stacking apparatus 80 (Y in Step S401), evaluation is made to see if the setting the mixed stacking status for the current job (next job) is "Enabled" or not (Step S402). If the status is "Disabled" (N in Step S402), the start of the image formation for this job is postponed, thereby disabling ejection of paper for this job to the stacking section 81 (Step S404). Further, the message of removing the paper of the preceding job from the stacking section 81 of the stacking apparatus 80 is displayed on the operation display section 220 (Step S405). This arrangement allows the user to recognize that execution of the job is being suspended in order to prevent the sheets of paper involved in two or more jobs, from being stacked in one and the same stacking section. The user is also informed of what action should be taken. For example, an action message such as "Remove paper from the stacker" appears on the screen.

When the mixed stacking of the current job is "Disabled" (Y in Step S402), a decision is made on whether or not the mixed stacking of the preceding job is set to "Enabled" (Step S403). If the mixed stacking of the preceding job is set to "Disabled", ejection of paper to the stacking section 81 in the image formation of the current job is disabled, in the similar manner to the above (Step S404). This situation is displayed in the form of a message (Step S405).

If the mixed stacking of the preceding job is set to "Enabled" (Y in Step S403), the processing of image formation of this job is started, and the paper with the image formed thereon is ejected to the stacking section 81 (Step S406).

If paper is removed from the stacking section 81 after paper ejection has been removed (N in Step S401), processing of the image formation of the job having been suspended is started, and ejection of paper to the stacking section 81 starts (Step S406).

FIG. 7 provides a list summarizing the result of evaluation when paper remains in the stacking section 81. Paper ejection starts only when mixed stacking is enabled for both the preceding job and execution job (the current job or next job as viewed from the preceding job). If the mixed stacking is disabled for either the preceding job or execution job, paper ejection is disabled.

Incidentally, when it is possible to set to a stacking section of the ejection destination different for each job, the following paper ejection should be controlled: In Step S401, evaluation is made to determine whether or not paper remains in the stacking section designated as an ejection destination of the current job. In Step S403, evaluation should be made on the preceding job where the paper ejection destination is designated to the same stacking section as that of the current job.

The setting of the mixed stacking of the preceding job is stored in the system memory 107 at least until the start of processing of image formation in the next job where the same stacking section is set as the ejection destination, or until removal of paper from the stacking section as an ejection destination of the preceding job.

A plurality of stacking sections 81 can be provided. The following describes the case where the first and second stacking sections are provided:

The second stacking section is also provided with a stacker residual paper detecting section.

When the mixed stacking is disabled and there is recording paper of the preceding job in the first stacking section, the presence/absence of recording paper in the second stacking section is detected by the stacker residual paper detecting section. If there is no recording paper, paper is ejected to the second stacking section. In the meantime, if recording paper is present in the second stacking section as well, ejection is disabled. If there are a third and subsequent stacking sections, the same processing can be applied.

Figure 8:
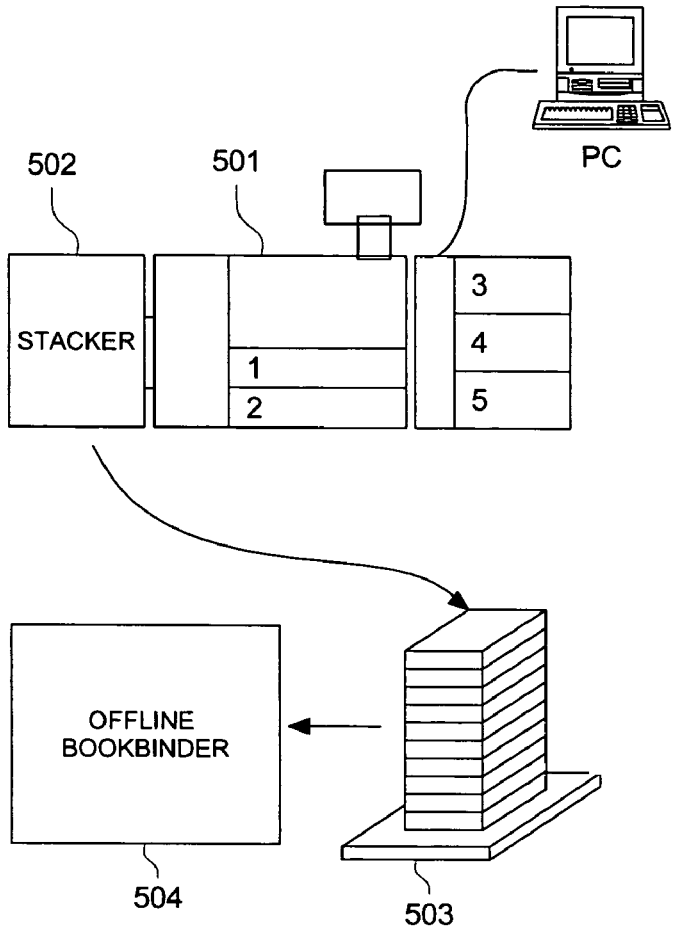
FIG. 8 is an explanatory diagram representing an example of work flow when bookbinding is performed by an offline post-processor.

As shown in FIG. 8, when bookbinding is performed by the online post-processor, the mixed stacking is set to "Disabled" and job request is issued. This arrangement prevents sheets of paper of two or more jobs from being stacked on one and the same stacking section in a mixed form, an efficient printing work flow can be ensured, without the need of performing the sorting work.

Figure 9:
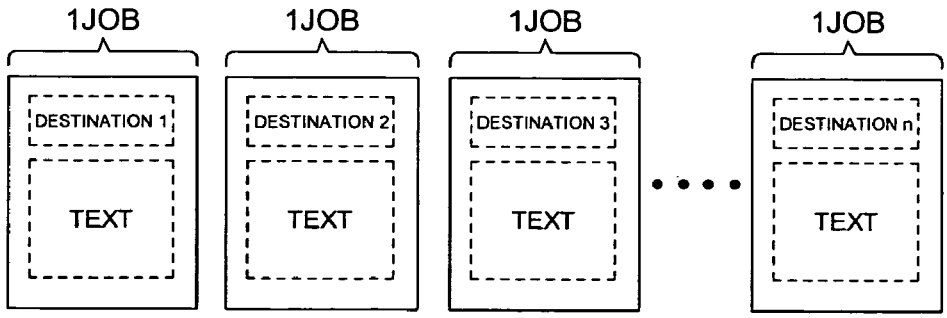
FIG. 9 is an explanatory diagram representing an example of the configuration of a job when printing a large volume of documents for direct mail.
Figure 10:
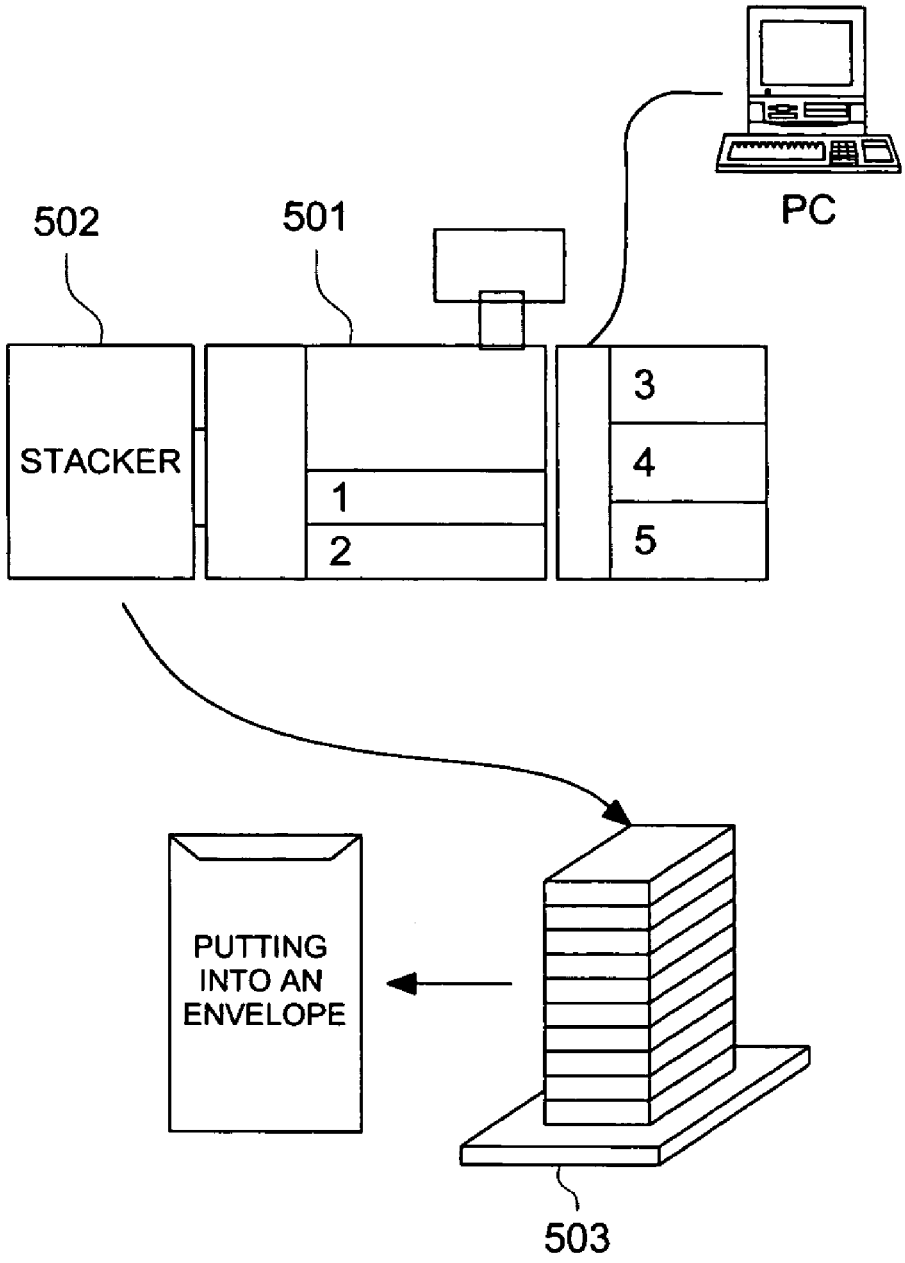
FIG. 10 is an explanatory diagram representing an example of work flow when creating a large volume of direct mail.

When printing work as in a data center is to be performed, as shown in FIGS. 9 and 10, the mixed stacking is set to "Enabled" and the job request is issued. Then sheets of paper of a plurality of jobs are stacked continuously on the stacking section. This eliminates the trouble of removing paper from the stacking section for each job, and ensures a smooth printing work flow.

The above has described the embodiment of the present invention with reference to drawings. A specific configuration is not restricted to those shown in the embodiments. The present invention includes the modification and addition that have been made without departing from the spirit of the present invention. For example, in the aforementioned embodiment, the enable/disable status of the mixed stacking is set for each job. It is also possible to make such arrangements that the enable/disable status of the mixed stacking can be set for each operation of the apparatus in the configuration setting or initialization. In this case, assume that paper remains in the stacking section designated as the paper ejection destination of that job when starting the processing of image formation of a certain job, and the mixed stacking is set to "Disabled" in the apparatus. Then it is also possible to arrange such a configuration that ejection of paper to that stacking section is disabled in such a case; and otherwise, ejection of paper is enabled.

In the above description of the embodiment, an example of a digital multifunction device is used for explanation of an image forming apparatus. A printer or a printing press, for example, can be used only if an image is formed on paper and is outputted.

What is claimed is:

1. An image forming apparatus, comprising:

an image forming section to form an image on a sheet and to discharge the sheet on which the image is formed;

a stacking section to stack the sheet discharged from the image forming section;

a setting section to set a condition whether or not to allow a mixed stack mode on which plural sheets related to at least two different jobs are mixed and stacked in the stacking section; and a discharge control section to control the image forming section to discharge the sheet to the stacking section in accordance with the setting condition whether or not to allow the mixed stack modes, wherein the discharge control section controls the image forming section to discharge the sheet related to a current job to the stacking section in accordance with the setting condition whether or not to allow the mixed stack mode for the current job.

2. An image forming apparatus, comprising:

an image forming section to form an image on a sheet and to discharge the sheet on which the image is formed;

a stacking section to stack the sheet discharged from the image forming section;

a setting section to set a condition whether or not to allow a mixed stack mode on which plural sheets related to at least two different jobs are mixed and stacked in the stacking section;

a discharge control section to control the image forming section to discharge the sheet to the stacking section in accordance with the setting condition whether or not to allow the mixed stack mode; and a remaining sheet detecting device to detect whether or not a previously-discharged sheet is stacked in the stacking section.

3. The image forming apparatus of claim 2, wherein the discharge control section prohibits the image forming section to discharge the sheet to the stacking section in accordance with the setting condition and a detection result of the remaining sheet detection device.

4. An image forming apparatus, comprising:

an image forming section to form an image on a sheet and to discharge the sheet on which the image is formed;

a stacking section to stack the sheet discharged from the image forming section;

a setting section to set a condition whether or not to allow a mixed stack mode on which plural sheets related to at least two different jobs are mixed and stacked in the stacking section; and a discharge control section to control the image forming section to discharge the sheet to the stacking section in accordance with the setting condition whether or not to allow the mixed stack mode, wherein when the sheet related to a previous job is stacked in the stacking section, the discharge control section controls the image forming section to discharge the sheet related to a next job in accordance with the setting condition for the previous job and the setting condition for the next job.

5. The image forming apparatus of claim 4, wherein when the sheet related to the previous job is stacked in the stacking section, the discharge control section prohibits the image forming section to discharge the sheet related to the next job in accordance with the setting condition for the previous job and the setting condition for the next job.

6. An image forming apparatus, comprising:

an image forming section to form an image on a sheet and to discharge the sheet on which the image is formed;

a stacking section to stack the sheet discharged from the image forming section;

a setting section to set a condition whether or not to allow a mixed stack mode on which plural sheets related to at least two different jobs are mixed and stacked in the stacking section; and a discharge control section to control the image forming section to discharge the sheet to the stacking section in accordance with the setting condition whether or not to allow the mixed stack mode, wherein the discharge control section prohibits the image forming section to discharge the sheet to the stacking section in accordance with the setting condition, and wherein when the setting conditions of both of a previous job and the a next job are set to allow the mixed stack mode, the discharge control section allows the image forming section to discharge the sheet to the stacking section.

7. An image forming apparatus, comprising:

an image forming section to form an image on a sheet and to discharge the sheet on which the image is formed;

a stacking section to stack the sheet discharged from the image forming section;

a setting section to set a condition whether or not to allow a mixed stack mode on which plural sheets related to at least two different jobs are mixed and stacked in the stacking section; and a discharge control section to control the image forming section to discharge the sheet to the stacking section in accordance with the setting condition whether or not to allow the mixed stack mode, wherein the discharge control section prohibits the image forming section to discharge the sheet to the stacking section in accordance with the setting condition, and wherein when the setting condition of a previous job is set not to allow the mixed stack mode, the discharge control section prohibits the image forming section to discharge the sheet to the stacking section at least while the sheet related to the previous job is stacked in the stacking section.

8. An image forming apparatus, comprising:

an image forming section to form an image on a sheet and to discharge the sheet on which the image is formed;

a stacking section to stack the sheet discharged from the image forming section;

a setting section to set a condition whether or not to allow a mixed stack mode on which plural sheets related to at least two different jobs are mixed and stacked in the stacking section; and a discharge control section to control the image forming section to discharge the sheet to the stacking section in accordance with the setting condition whether or not to allow the mixed stack mode, wherein the discharge control section prohibits the image forming section to discharge the sheet to the stacking section in accordance with the setting condition, and wherein when the setting condition of a next job is set not to allow the mixed stack mode, the discharge control section prohibits the image forming section to discharge the sheet to the stacking section at least while the sheet related to a previous job is stacked in the stacking section.

9. An image forming apparatus, comprising:

an image forming section to form an image on a sheet and to discharge the sheet on which the image is formed;

a stacking section to stack the sheet discharged from the image forming section;

a setting section to set a condition whether or not to allow a mixed stack mode on which plural sheets related to at least two different jobs are mixed and stacked in the stacking section; and a discharge control section to control the image forming section to discharge the sheet to the stacking section in accordance with the setting condition whether or not to allow the mixed stack mode, wherein the discharge control section prohibits the image forming section to discharge the sheet to the stacking section in accordance with the setting condition, and wherein when the discharge control section prohibits the image forming section to discharge the sheet related to a next job to the stacking section, an informing section informs the prohibition for the sheet related to the next job.

10. An image forming apparatus, comprising:

an image forming section to form an image on a sheet and to discharge the sheet on which the image is formed;

a stacking section to stack the sheet discharged from the image forming section;

a setting section to set a condition whether or not to allow a mixed stack mode on which plural sheets related to at least two different jobs are mixed and stacked in the stacking section; and a discharge control section to control the image forming section to discharge the sheet to the stacking section in accordance with the setting condition whether or not to allow the mixed stack mode, wherein the setting section receives the setting condition whether or not to allow the mixed stack mode from an external apparatus.

11. An image forming apparatus, comprising:

an image forming section to form an image on a sheet and to discharge the sheet on which the image is formed;

a stacking section to stack the sheet discharged from the image forming section;

a setting section to set a condition whether or not to allow a mixed stack mode on which plural sheets related to at least two different jobs are mixed and stacked in the stacking section; and a discharge control section to control the image forming section to discharge the sheet to the stacking section in accordance with the setting condition whether or not to allow the mixed stack mode, wherein the discharge control section prohibits the image forming section to conduct an image forming operation for a next job so that the image forming section is prohibited to discharge a sheet related to the next job.

12. An image forming apparatus, comprising:

an image forming section to form an image on a sheet and to discharge the sheet on which the image is formed;

a stacking section to stack the sheet discharged from the image forming section;

a setting section to set a condition whether or not to allow a mixed stack mode on which plural sheets related to at least two different jobs are mixed and stacked in the stacking section; and a discharge control section to control the image forming section to discharge the sheet to the stacking section in accordance with the setting condition whether or not to allow the mixed stack mode, wherein the setting section sets the setting condition whether or not to allow the mixed stack mode as a default value, and wherein the setting section changes the default value of the setting condition in accordance with a requirement.

13. An image forming apparatus, comprising:

an image forming section to form an image on a sheet and to discharge the sheet on which the image is formed;

a stacking section to stack the sheet discharged from the image forming section;

a setting section to set a condition whether or not to allow a mixed stack mode on which plural sheets related to at least two different jobs are mixed and stacked in the stacking section; and a discharge control section to control the image forming section to discharge the sheet to the stacking section in accordance with the setting condition whether or not to allow the mixed stack mode, wherein the discharge control section prohibits the image forming section to discharge the sheet to the stacking section in accordance with the setting condition, wherein the stacking section comprises a first stacking section and a second stacking section, and wherein when the image forming section is prohibited to discharge a sheet to the first stacking section, the image forming section is allowed to discharge a sheet to the second stacking section.

14. An image forming apparatus, comprising:

an image forming section to form an image on a sheet and to discharge the sheet on which the image is formed;

a stacking section to stack the sheet discharged from the image forming section;

a setting section to set a condition whether or not to allow a mixed stack mode on which plural sheets related to at least two different jobs are mixed and stacked in the stacking section; and a discharge control section to control the image forming section to discharge the sheet to the stacking section in accordance with the setting condition whether or not to allow the mixed stack mode, wherein the discharge control section prohibits the image forming section to discharge the sheet to the stacking section in accordance with the setting condition, wherein the stacking section comprises a first stacking section, a second stacking section, and a second remaining sheet detecting device to detect whether or not a previously-discharged sheet is stacked in the second stacking section, and wherein when the discharge control section prohibits the image forming section to discharge the sheet to the first stacking section, the discharge control section controls the image forming section to discharge a sheet to the second stacking section in accordance with a detection result of the second remaining sheet detecting device.

15. The image forming apparatus of claim 10, further comprising:

a remaining sheet detecting device to detect whether or not a previously-discharged sheet is stacked in the stacking section.

16. The image forming apparatus of claim 10, wherein when the setting conditions of both of a previous job and a next job are set to allow the mixed stack mode, the discharge control section allows the image forming section to discharge the sheet to the stacking section.

17. The image forming apparatus of claim 10, wherein when the setting condition of a previous job is set not to allow the mixed stack mode, the discharge control section prohibits the image forming section to discharge the sheet to the stacking section at least while the sheet related to the previous job is stacked in the stacking section.

18. The image forming apparatus of claim 10, wherein when the setting condition of a next job is set not to allow the mixed stack mode, the discharge control section prohibits the image forming section to discharge the sheet to the stacking section at least while the sheet related to a previous job is stacked in the stacking section.

19. The image forming apparatus of claim 11, further comprising:

a remaining sheet detecting device to detect whether or not a previously-discharged sheet is stacked in the stacking section.

20. The image forming apparatus of claim 11, wherein when the setting conditions of both of a previous job and a next job are set to allow the mixed stack mode, the discharge control section allows the image forming section to discharge the sheet to the stacking section.

21. The image forming apparatus of claim 11, wherein when the setting condition of a previous job is set not to allow the mixed stack mode, the discharge control section prohibits the image forming section to discharge the sheet to the stacking section at least while the sheet related to the previous job is stacked in the stacking section.

22. The image forming apparatus of claim 11, wherein when the setting condition of a next job is set not to allow the mixed stack mode, the discharge control section prohibits the image forming section to discharge the sheet to the stacking section at least while the sheet related to a previous job is stacked in the stacking section.

23. The image forming apparatus of claim 2, wherein when the setting conditions of both of a previous job and a next job are set to allow the mixed stack mode, the discharge control section allows the image forming section to discharge the sheet to the stacking section.

24. The image forming apparatus of claim 2, wherein when the setting condition of a previous job is set not to allow the mixed stack mode, the discharge control section prohibits the image forming section to discharge the sheet to the stacking section at least while the sheet related to the previous job is stacked in the stacking section.

25. The image forming apparatus of claim 2, wherein when the setting condition of a next job is set not to allow the mixed stack mode, the discharge control section prohibits the image forming section to discharge the sheet to the stacking section at least while the sheet related to a previous job is stacked in the stacking section.

26. The image forming apparatus of claim 1, wherein when the setting condition of a previous job is set not to allow the mixed stack mode, the discharge control section prohibits the image forming section to discharge the sheet to the stacking section at least while the sheet related to the previous job is stacked in the stacking section.

27. The image forming apparatus of claim 6, further comprising:

a remaining sheet detecting device to detect whether or not a previously-discharged sheet is stacked in the stacking section.

28. The image forming apparatus of claim 27, wherein the discharge control section prohibits the image forming section to discharge the sheet to the stacking section in accordance with the setting condition and a detection result of the remaining sheet detection device.

29. The image forming apparatus of claim 7, further comprising:

a remaining sheet detecting device to detect whether or not a previously-discharged sheet is stacked in the stacking section.

30. The image forming apparatus of claim 29, wherein the discharge control section prohibits the image forming section to discharge the sheet to the stacking section in accordance with the setting condition and a detection result of the remaining sheet detection device.

31. The image forming apparatus of claim 8, further comprising:

a remaining sheet detecting device to detect whether or not a previously-discharged sheet is stacked in the stacking section.

32. The image forming apparatus of claim 31, wherein the discharge control section prohibits the image forming section to discharge the sheet to the stacking section in accordance with the setting condition and a detection result of the remaining sheet detection device.

* * * * *